US007316800B1

(12) United States Patent
Dardik et al.

(10) Patent No.: US 7,316,800 B1
(45) Date of Patent: Jan. 8, 2008

(54) ELECTROMAGNETIC HELICAL PUMP FOR HIGH-TEMPERATURE TRANSPORTATION OF MOLTEN METAL

(75) Inventors: Irving I. Dardik, Califon, NJ (US); Arkady K. Kapusta, Beer-Sheva (IL); Boris M. Mikhailovich, Beer-Sheva (IL); Ephim G. Golbraikh, Beer-Sheva (IL); Shaul Lesin, Meitar (IL); Herman Branover, Omer (IL)

(73) Assignee: Energetics Technologies, L.L.C., Califon, NJ (US)

( * ) Notice: Subject to any disclaimer, the term of this patent is extended or adjusted under 35 U.S.C. 154(b) by 427 days.

(21) Appl. No.: 11/061,917

(22) Filed: Feb. 18, 2005

Related U.S. Application Data

(60) Provisional application No. 60/546,113, filed on Feb. 18, 2004.

(51) Int. Cl.
*C21C 5/42* (2006.01)

(52) U.S. Cl. ..... 266/237

(58) Field of Classification Search ..... 266/237
See application file for complete search history.

(56) References Cited

U.S. PATENT DOCUMENTS 3,251,302 A * 5/1966 Baker ..... 417/50
3,759,635 A * 9/1973 Carter et al. ..... 266/237
4,212,592 A 7/1980 Olich et al.
4,775,298 A 10/1988 Lauhoff et al.

OTHER PUBLICATIONS

Dardik, I. I., "The Great Law of the Universe," Cycles, Foundation for the Study of Cycles, Wayne, PA, U.S., vol. 44, Mar. 1994, pp. 265-277.

* cited by examiner

*Primary Examiner*—Scott Kastler
(74) *Attorney, Agent, or Firm*—Greenberg Traurig LLP; Paul F. McQuade

(57) ABSTRACT

Electromagnetic helical pump for high-temperature transportation of molten metal, comprising an explicit-pole or implicit-pole inductor exciting a rotating magnetic field (RMF), and a helical channel consisting of a thick-wall ceramic pipe with a quick-change helical core made of graphite or graphitized carbon. The pump can be used for transportation and batching of molten aluminum, magnesium, copper, etc. and their alloys.

8 Claims, 7 Drawing Sheets

ELECTROMAGNETIC HELICAL PUMP FOR HIGH-TEMPERATURE TRANSPORTATION OF MOLTEN METAL

This application claims the benefit of U.S. provisional patent application No. 60/546,113, filed Feb. 18, 2004, which is hereby incorporated by reference herein in its entirety.

BACKGROUND OF THE INVENTION

The present invention relates generally to electromagnetic helical pumps, and more particularly to electromagnetic helical pumps for high-temperature transportation of molten metals.

Electromagnetic helical induction pumps are well known. See, for example, Olich et al. U.S. Pat. No. 4,212,592 and Lauhoff et al. U.S. Pat. No. 4,775,298, each of which is hereby incorporated by reference herein in its entirety. Particular design modifications to these types of pumps make it possible to transport melts of certain metals and alloys (mainly alkali and alkaline-earth metals) at temperatures up to 800° Celsius.

However, previous designs have been inapplicable for certain aggressive metals, such as liquid copper, aluminum, or their alloys, since helical channels in such pumps have been stationary and made of nonmagnetic steel that rapidly erodes from the motion of these metals. Currently, no serviceable designs of helical pumps for molten aggressive metals (e.g., copper, aluminum, etc.), or alloys thereof, are known.

Accordingly, it would be desirable to provide electromagnetic helical pumps for high-temperature transportation or batching of such aggressive molten metals.

SUMMARY OF THE INVENTION

It is, therefore, an object of this invention to provide electromagnetic helical pumps for high-temperature transportation of molten metals.

It is also an object of this invention to provide such pumps with quickly replaceable helical cores.

In accordance with one embodiment of the present invention, there is provided an electromagnetic helical pump for high-temperature transportation of molten metal that includes an inductor exciting RMF and a helical channel, wherein the helical channel is made of a ceramic pipe and a quick-change helical core made of graphite or graphitized carbon.

BRIEF DESCRIPTION OF THE DRAWINGS

The above and other advantages of the invention will be more apparent upon consideration of the following detailed description, taken in conjunction with the accompanying drawings, in which like reference characters refer to like parts throughout, and in which.

DETAILED DESCRIPTION OF THE PREFERRED EMBODIMENTS

The present invention provides electromagnetic helical pumps for high-temperature transportation of molten metals. The proposed helical pump design can be used for transportation or batching of aggressive melts with temperatures above 1000° Celsius.

The pump includes a helical channel or passageway, through which the molten metals can flow, and a magnetic circuit for generating a rotating magnetic field ("RMF") in the helical channel. The magnetic field rotation axis is coaxial with the central axis of the helical channel, such that RMF is excited in the helical channel and induces a rotating current density field in the liquid metal. The interaction of this field with RMF generates tangential electromagnetic body forces that create electromagnetic pressure in the helical channel of the pump. This pressure displaces the molten metals upwards in the helical channel.

In accordance with one aspect of this invention, a thermostable helical channel of the pump is preferably provided by a helical space to be filled with molten metal created between a replaceable graphite or graphitized carbon core, which is preferably reinforced and supported by a steel rod, and a thick-walled ceramic pipe, whose material preferably does not rapidly erode from the motion of the molten metals.

Since graphite and graphitized carbon still erode over time, the pump design of a preferred embodiment of this invention may provide for a quick replacement of the helical core.

Figure 1:
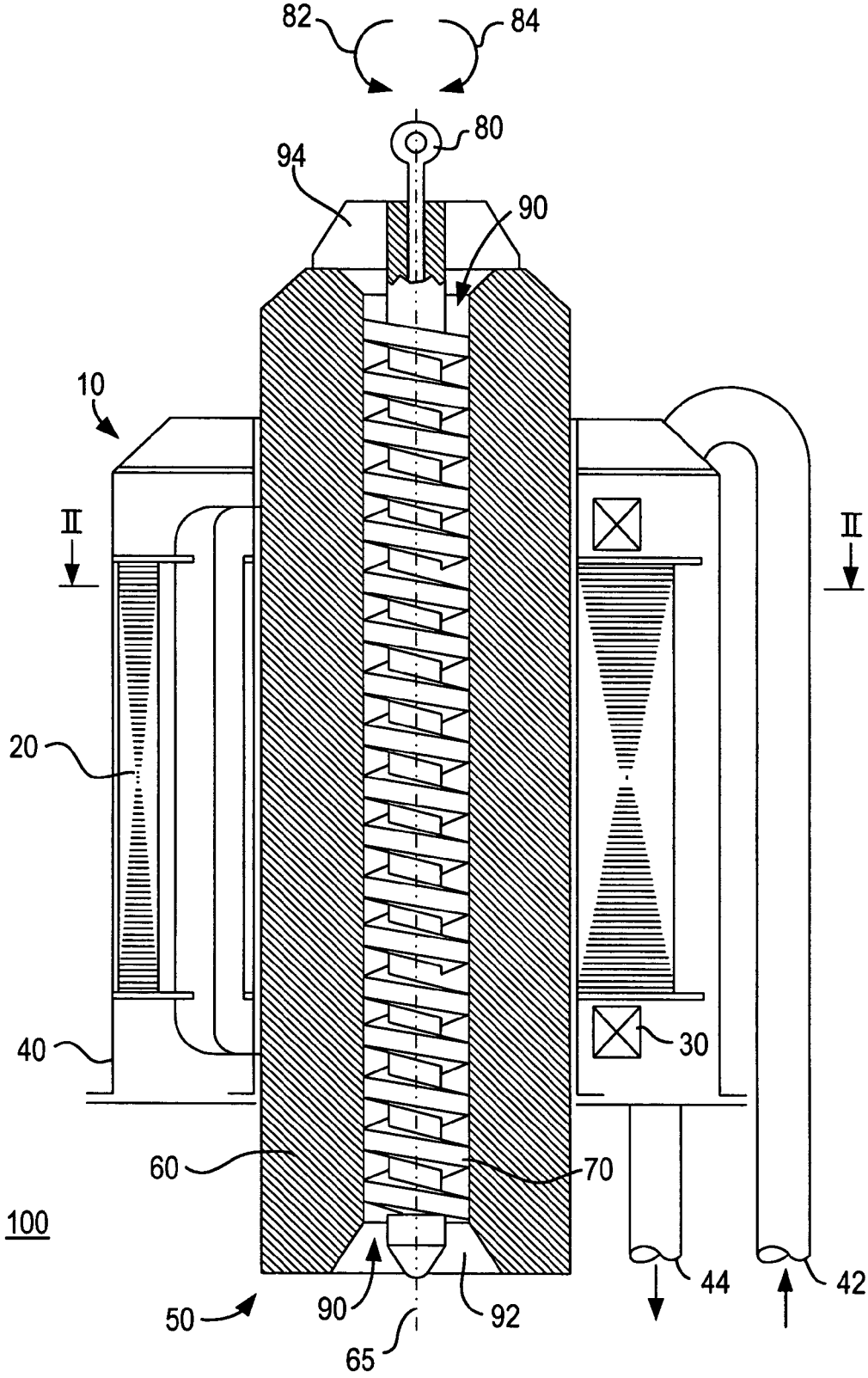
FIG. 1 is a vertical cross-sectional view of one embodiment of an electromagnetic pump constructed in accordance with the present invention, taken from line I-I of FIG. 2.
Figure 2:
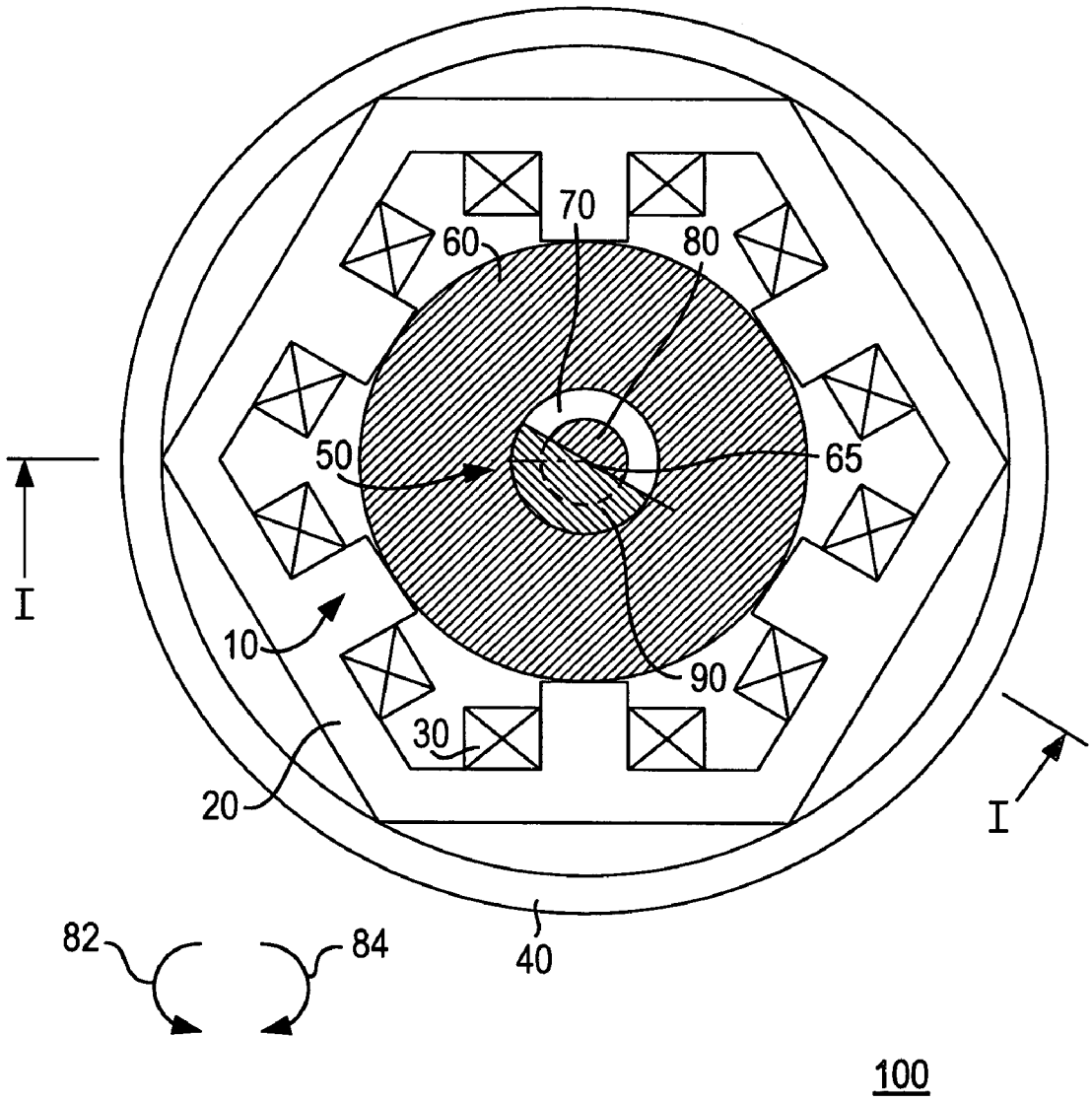
FIG. 2 is a horizontal cross-sectional view of the electromagnetic pump of FIG. 1, taken from line II-II of FIG. 1.

Referring to FIGS. 1 and 2, a preferred embodiment of an electromagnetic pump constructed in accordance with the present invention is shown. Pump 100 includes a magnetic circuit or inductor 10 and a helical channel 50. Inductor 10 may preferably be made of electrotechnical steel sheet 20, and a plurality of RMF excitation coils 30 made of copper or aluminum electrically insulated wire or electrically insulated copper tube of circular or rectangular cross-section, for example.

Helical channel 50 may preferably include a ceramic pipe 60 having a longitudinal axis 65, and a helical rod 70 made of graphite or graphitized carbon, for example, with a thin steel central rod 80 arranged thereinside that is concentric with pipe 60 about axis 65. In other embodiments of the present invention, central rod 80 may be made of any metals and alloys or metalloceramics with a melting temperature above that of the pumped melt. Central rod 80, whose diameter may be much smaller than the internal diameter of the helical channel on rod 70, is arranged for reinforcing, mounting, and dismantling helical rod 70. Helical passageway or channel 90 is thereby provided by the space created along helical rod 70 between pipe 60 and central rod 80.

As shown in FIGS. 1 and 2, pipe 60 may be threaded such that helical rod 70 may be screwed into and out of core 50 along axis 65 by turning helical rod 70 in the clockwise direction of arrow 82 and in the counter-clockwise direction of arrow 84, respectively. This enables quick replacement of helical rod 70, which may be desirable because graphite and graphitized carbon can erode over time. In an other embodiment of the present invention, pipe 60 and rod 70 may create a tight fit that obviates the need for threading but still enables quick replacement of helical rod 70.

Central rod 80 may be rigidly coupled to helical rod 70 and may serve to remove helical rod 70 out of channel 50. Jacket 40, which may preferably be made of thin nonmagnetic steel, or any other suitable material, may isolate inductor 10 from the furnace lining and channel 50, and may be arranged for air cooling of the windings and magnetic core of inductor 10.

Figure 3:
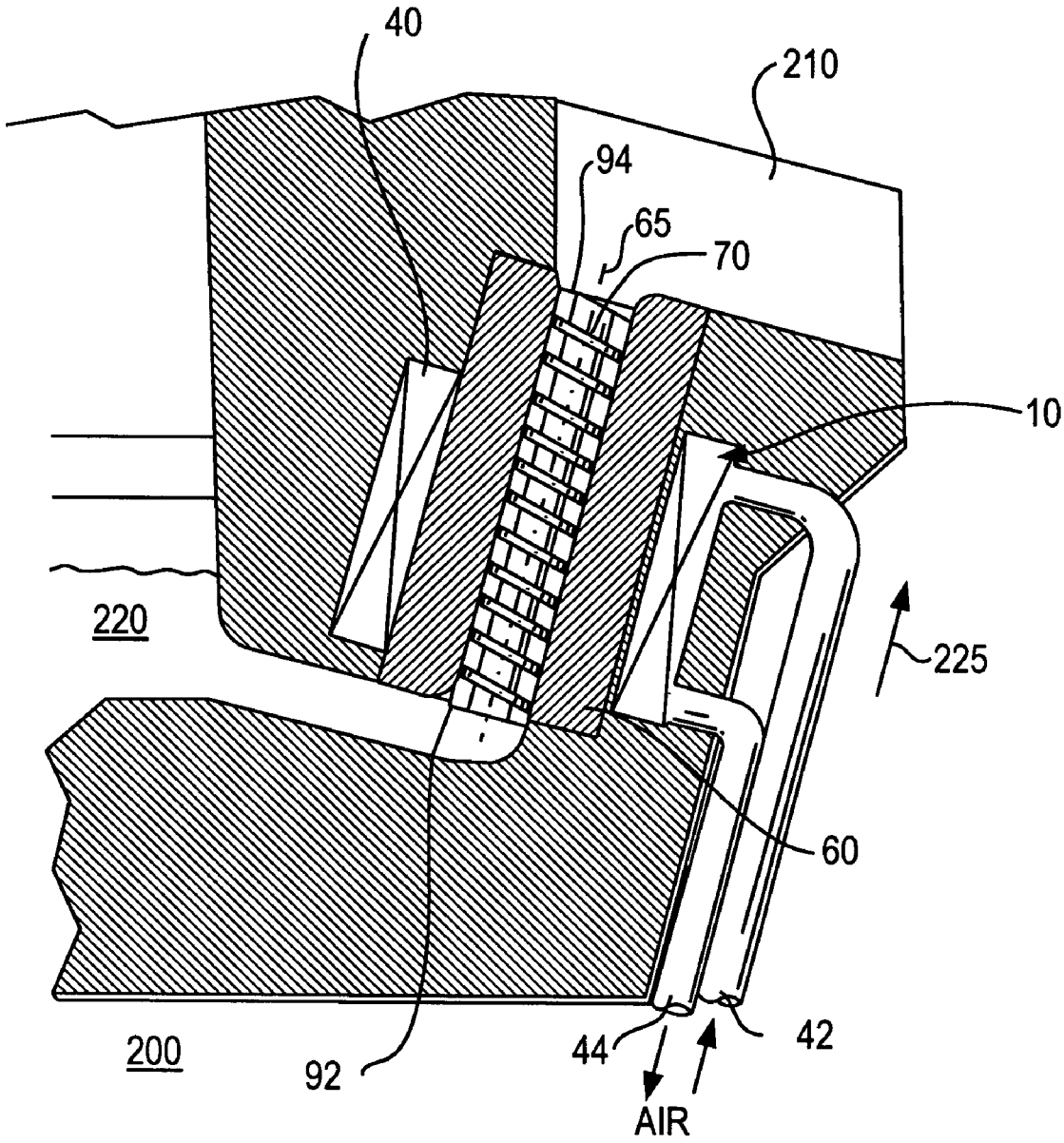
FIG. 3 is a vertical cross-sectional view of a furnace incorporating the electromagnetic pump of FIGS. 1 and 2 in accordance with the present invention.

Referring to FIG. 3, in accordance with the present invention, pump 100 can be placed into discharge lip 210 of a furnace 200 so that the turns of helical channel 90 at inlet 92 located inside RMF are partially filled with molten metal 220.

When the pump excitation windings 30 are connected to a three-phase voltage power supply (not shown), RMF is excited in helical channel 90 and induces a rotating current density field in the liquid metal 220. The interaction of this field with RMF generates tangential electromagnetic body forces creating electromagnetic pressure in helical channel 90 of pump 100, which displaces melt 220 upwards in the direction of arrow 225 along axis 65 of pump 100 from inlet 92 to outlet 94.

In a preferred embodiment, air cooling of inductor 10 may be realized by air blown through jacket 40. As shown in FIGS. 1-3, compressed air for cooling inductor 10 may be fed into and out of jacket 40 via air inlet 42 and air outlet 44.

Figure 4:
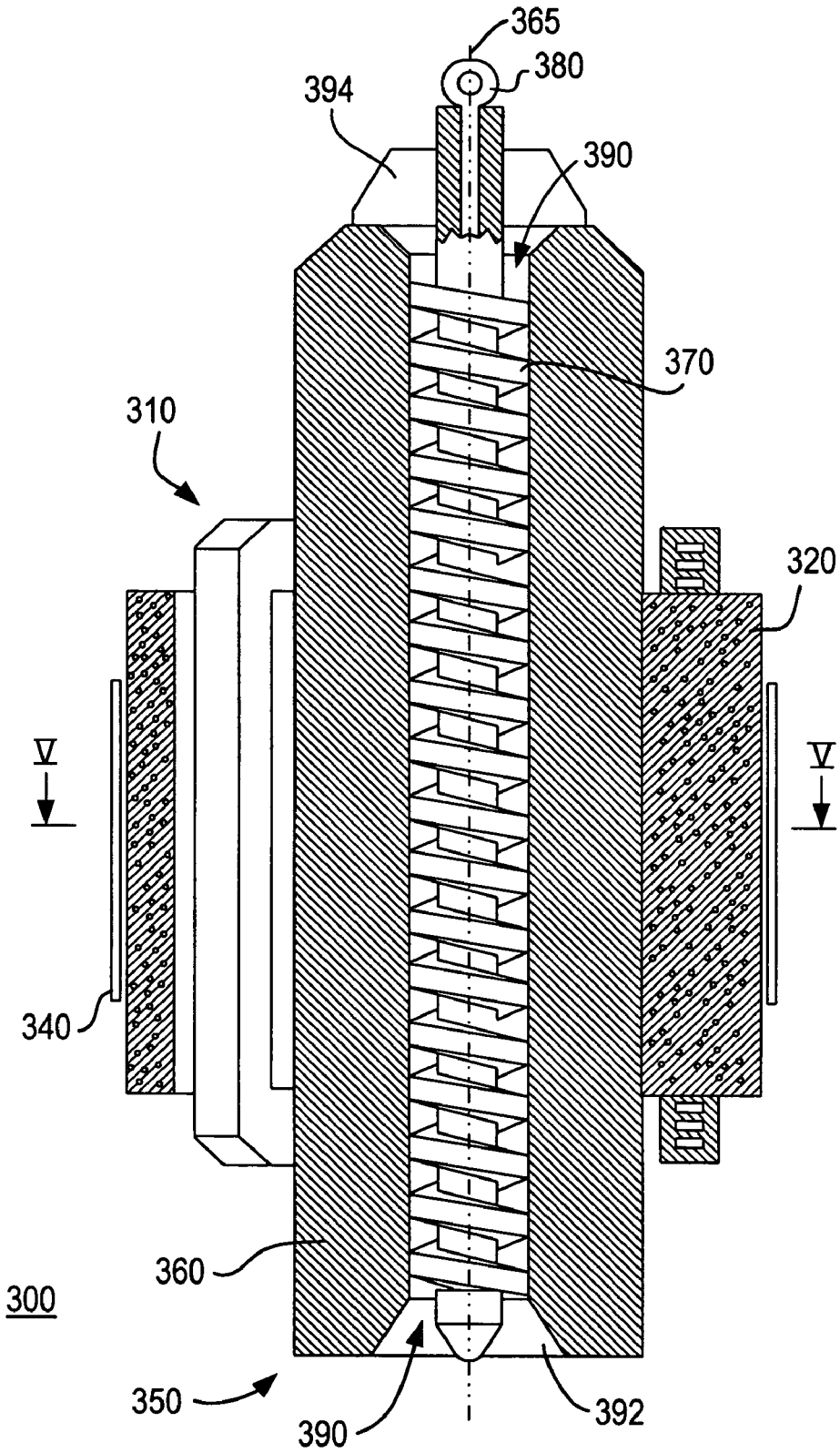
FIG. 4 is a vertical cross-sectional view of an other embodiment of an electromagnetic pump constructed in accordance with the present invention, taken from line IV-IV of FIG. 5.
Figure 5:
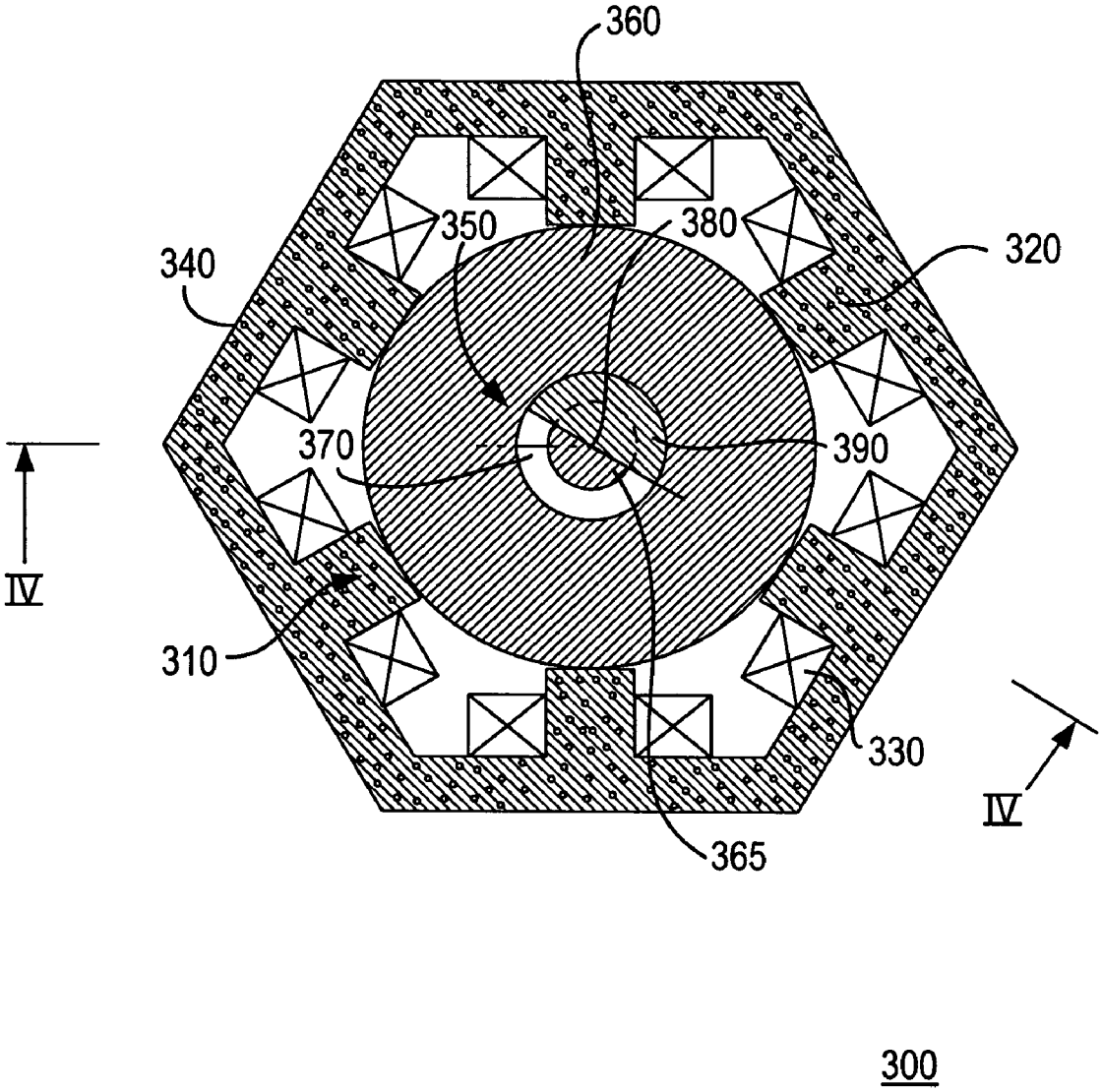
FIG. 5 is a horizontal cross-sectional view of the electromagnetic pump of FIG. 4, taken from line V-V of FIG. 4.

Referring to FIGS. 4 and 5, an other embodiment of an electromagnetic pump constructed in accordance with the present invention is shown. Pump 300 includes a magnetic circuit or inductor 310 and a helical channel 350. Inductor 310 may preferably include ferroceramic elements 320, and a plurality of RMF excitation coils 330 made of any suitable type of thermo-stable ceramic boxes, for example. Inside the boxes, helical channels may be provided and filled with solid or liquid metal, whose melting temperature is lower than the temperature of the lining surrounding the inductor, and whose boiling temperature is higher than the temperature of the lining. Electrodes for electric current supply are preferably fixed at the ends of the helical channel. In other embodiments of the present invention, inductor 310 may be made in the form of boxes of thin carbon steel filled with iron or cobalt powder, for example.

Helical channel 350 may preferably include a pipe 360 similar to pipe 60 of FIGS. 1-3 having a longitudinal axis 365, and a helical rod 370 similar to rod 70 of FIGS. 1-3, for example. The construction of helical channel 350 does not differ from that of helical channel 50. Like central rod 80, rod 380 is arranged for reinforcing, mounting, and dismantling helical rod 370. Helical passageway or channel 390 is thereby provided by the space created between helical rod 370 and pipe 360. Like rod 70, rod 370 may be quickly replaced by unscrewing it from the threads of pipe 360.

Jacket 340, which may preferably be made of common carbon steel or any other suitable material, is preferably provided to surround inductor 310 and channel 350. Jacket 340 is arranged for mechanical coupling of the elements of inductor 310 and is not meant for inductor cooling since the proposed design of inductor 310 does not require such cooling.

Typically sinusoidal waveforms are applied to the excitation windings (e.g., windings 30 or 330) of induction pumps of the type described herein such that RMF is excited in the helical channel. In accordance with an other embodiment of the present invention, instead of typical sinusoidal and square waveforms, superwaves may be generated and applied to excitation windings 30 or 330 when the windings are connected to a power supply (not shown).

The "superwaves" pulse pattern is in accordance with superwaving activity as set forth in the theory advanced in the Irving I. Dardik article "The Great Law of the Universe" that appeared in the March/April 1994 issue of the "Cycles" Journal. This article is hereby incorporated herein by reference.

As pointed out in the Dardik article, it is generally accepted in science that all things in nature are composed of atoms that move around in perpetual motion, the atoms attracting each other when they are a little distance apart and repelling upon being squeezed into one another. In contradistinction, the Dardik hypothesis is that all things in the universe are composed of waves that wave, this activity being referred to as "superwaving." Superwaving gives rise to and is matter in motion (i.e., both change simultaneously to define matter-space-time).

Thus in nature, changes in the frequency and amplitude of a wave are not independent and different from one another, but are concurrently one and the same, representing two different hierarchical levels simultaneously. Any increase in wave frequency at the same time creates a new wave pattern, for all waves incorporate therein smaller waves and varying frequencies, and one cannot exist without the other.

Every wave necessarily incorporates smaller waves, and is contained by larger waves. Thus each high-amplitude low-frequency major wave is modulated by many higher frequency low-amplitude minor waves. Superwaving is an ongoing process of waves waving within one another.

Figure 6:
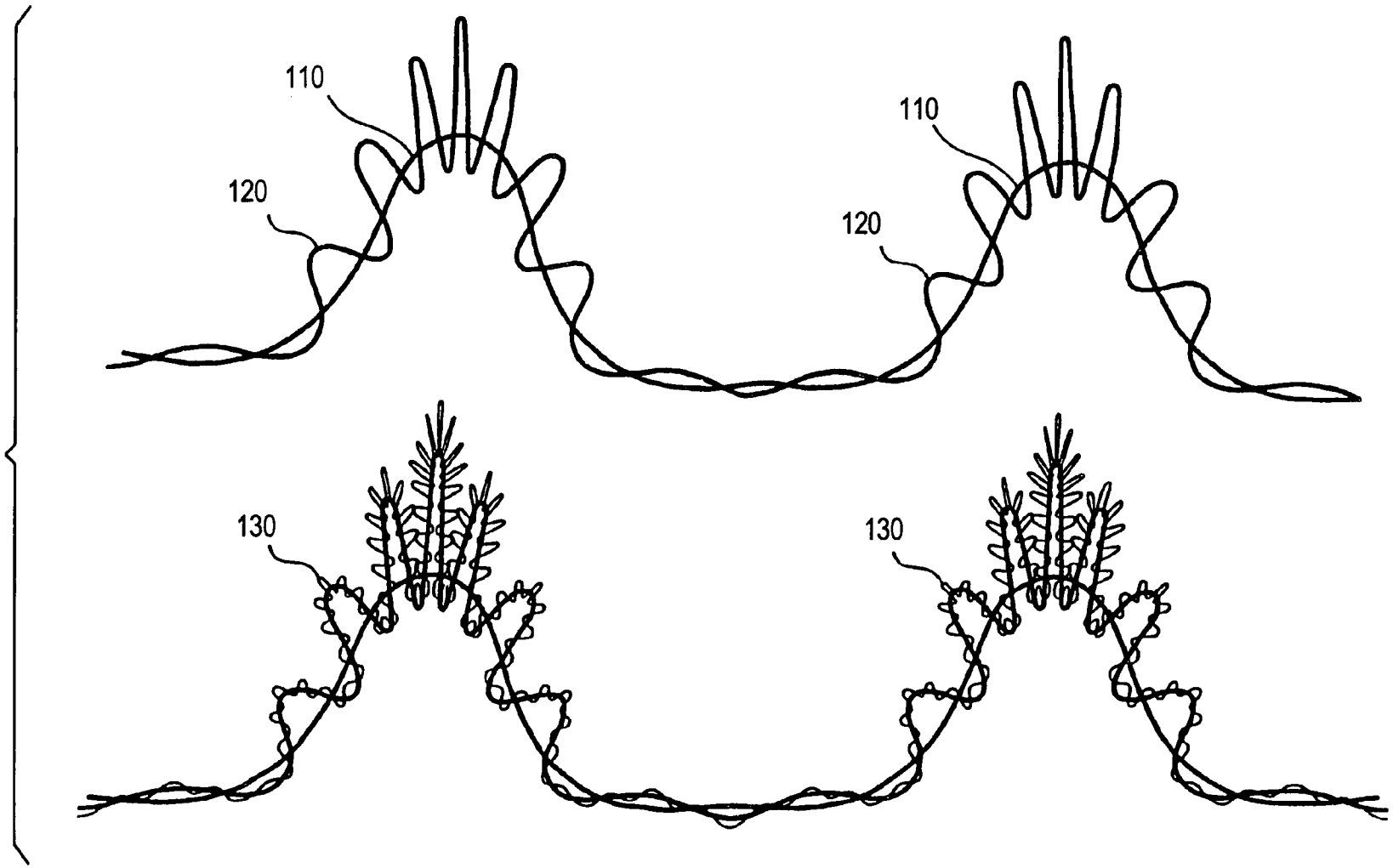
FIGS. 6 and 6A schematically illustrate superwaving wave phenomena.
Figure 6A:
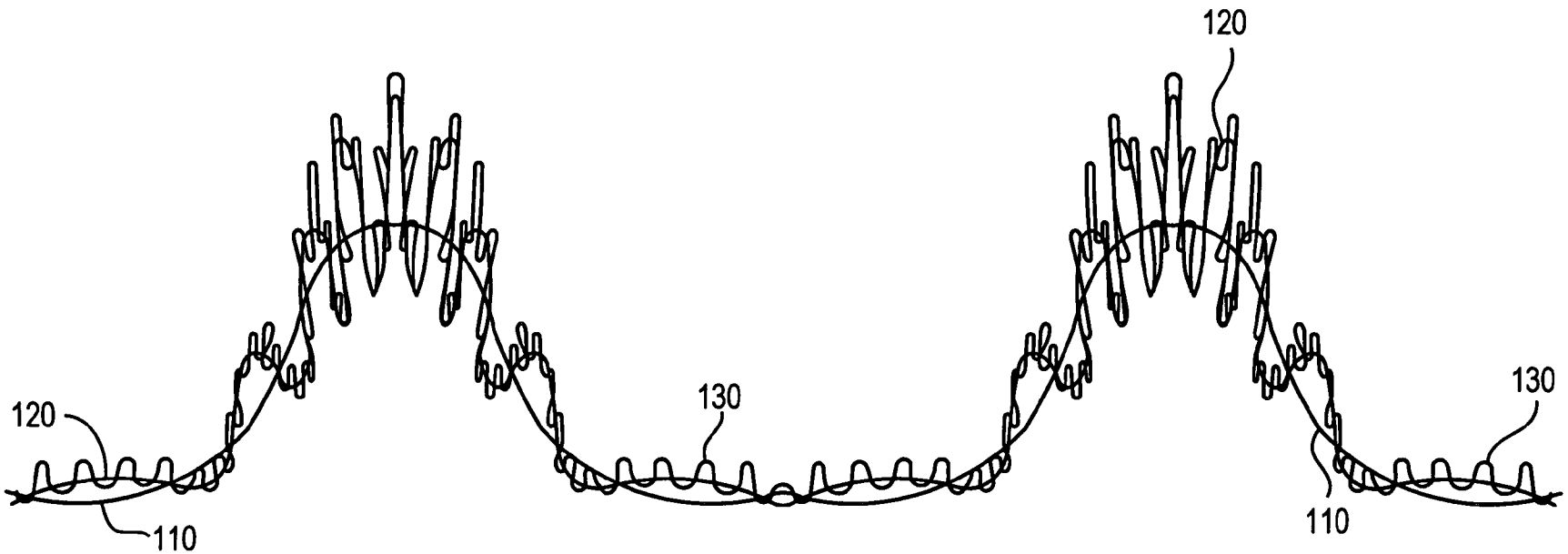

FIG. 6 (adapted from the illustrations in the Dardik article) schematically illustrates superwaving wave phenomena. FIG. 6 illustrates low-frequency major wave 110 modulated, for example, by minor waves 120 and 130. Minor waves 120 and 130 have progressively higher frequencies (compared to major wave 110). Other minor waves of even higher frequency may modulate major wave 110, but are not shown for clarity. This same superwaving wave phenomena is depicted in the time-domain in FIG. 6A.

This superwaving principle of waves waving demonstrates that wave frequency and wave intensity (amplitude squared) are simultaneous and continuous. The two different kinds of energy (i.e., energy carried by the waves that is proportional to their frequency, and energy proportional to their intensity) are also simultaneous and continuous. Energy therefore is waves waving, or "wave/energy." In accordance with the invention, the superwaving wave activity may be used to generate magnetic flux in a coil for enhanced transportation of molten metal using the helical pumps of the present invention (e.g., reduced friction, increased pumping pressure, etc.).

Various types of circuitries and devices made of various materials can be used to implement the pump as described above according to this invention.

It will be understood, therefore, that the foregoing is only illustrative of the principles of the invention, and that various modifications can be made by those skilled in the art without departing from the scope and spirit of the invention, and the present invention is limited only by the claims that follow.

What is claimed is:

1. An electromagnetic helical pump for high-temperature transportation of molten metal, comprising:

an inductor exciting RMF; and a helical channel, wherein the helical channel comprises:

a pipe; and a quick-change helical core made of at least one of the materials from the group consisting of the following: 1) graphite, or 2) graphitized carbon.

2. The electromagnetic helical pump of claim 1, wherein the pipe is a thick-wall ceramic pipe, whose material is not substantially destroyed under the action of the transported melt.

3. The electromagnetic helical pump of claim 1, wherein the inner surface of said pipe is made with a helical groove for screwing-in the outer edge of said helical core.

4. The electromagnetic helical pump of claim 1 or 3, wherein said helical channel comprises a rod for mounting and dismantling said helical core.

5. The electromagnetic helical pump of claim 4, wherein said rod is a thin steel rod.

6. The electromagnetic helical pump of claim 1, wherein a lining surrounds said inductor, and wherein said inductor comprises excitation coils made in the form of boxes filled with one of the elements from the group consisting of the following: 1) solid well-conducting metal, or 2) liquid well-conducting metal, whose boiling temperature exceeds the temperature of said lining.

7. The electromagnetic helical pump of claim 1, wherein said inductor further comprises a magnetic core, and wherein the magnetic core is made of high-temperature ferroceramics of at least one of the group consisting of the following: 1) ferrochamotte, 2) ferromagnesite, or 3) ferro-concrete.

8. The electromagnetic helical pump of claim 1, wherein said inductor is placed into a jacket made of nonmagnetic steel and cooled by compressed air.

* * * * *